US008807045B2

(12) United States Patent
Kim et al.

(10) Patent No.: US 8,807,045 B2
(45) Date of Patent: Aug. 19, 2014

(54) TRANSPORTATION APPARATUS HAVING INDUCED FREEZING RAIL SYSTEM

(75) Inventors: Young-Ho Kim, Daejeon (KR); Je-Hoon Yun, Daejeon (KR)

(73) Assignee: Electronics and Telecommunications Research Institute, Daejeon (KR)

( * ) Notice: Subject to any disclaimer, the term of this patent is extended or adjusted under 35 U.S.C. 154(b) by 331 days.

(21) Appl. No.: 12/815,803

(22) Filed: Jun. 15, 2010

(65) Prior Publication Data

US 2011/0146322 A1 Jun. 23, 2011

(30) Foreign Application Priority Data

Dec. 22, 2009 (KR) ..... 10-2009-0128923

(51) Int. Cl.
*A63G 21/00* (2006.01)
*B61D 17/00* (2006.01)

(52) U.S. Cl.
USPC ..... 104/134; 105/1.4

(58) Field of Classification Search
USPC ..... 104/53, 58, 59, 68–70, 73
See application file for complete search history.

(56) References Cited

U.S. PATENT DOCUMENTS

| | | | | |
|---|---|---|---|---|
| 3,815,901 | A * | 6/1974 | Wiig | 472/90 |
| 5,529,242 | A * | 6/1996 | Hedin | 239/14.2 |
| 6,612,388 | B2 * | 9/2003 | Henderson | 180/184 |
| 6,962,534 | B2 * | 11/2005 | Richter et al. | 472/90 |

FOREIGN PATENT DOCUMENTS

| | | | |
|---|---|---|---|
| JP | 58-163348 | U | 10/1983 |
| JP | 63-121602 | U | 8/1988 |
| JP | 64-036277 | U | 3/1989 |
| JP | 7-16540 | | 3/1995 |
| KR | 100544623 | A | 1/2006 |
| KR | 100744098 | B1 | 7/2007 |

OTHER PUBLICATIONS

Kim Keu Hong, "Future railroad technology for creating new growth engine", Aerodynamic Characteristics of a Tube Train, the Korean society for railway in 2008 regular general meeting and autumn academic conference, special seminar • special session, Nov. 2008, pp. 177-187.

* cited by examiner

*Primary Examiner* — Robert McCarry, Jr.
(74) *Attorney, Agent, or Firm* — Rabin & Berdo, P.C.

(57) ABSTRACT

A transportation apparatus configured to travel on rails and having an induced freezing rail system includes: a transportation vehicle having a support unit configured to support a frame from the rails; and a freezing rail system comprising freezing rails positioned on a ground surface corresponding to the support unit of the transportation vehicle, the freezing rails having a refrigerant and cooling devices.

10 Claims, 4 Drawing Sheets

TRANSPORTATION APPARATUS HAVING INDUCED FREEZING RAIL SYSTEM

CROSS-REFERENCE(S) TO RELATED APPLICATIONS

The present application claims priority of Korean Patent Application No. 10-2009-0128923, filed on Dec. 22, 2009, which is incorporated herein by reference in its entirety.

BACKGROUND OF THE INVENTION

1. Field of the Invention

Exemplary embodiments of the present invention relate to a transportation apparatus having an induced freezing rail system, which is a rail-based transportation apparatus such as conventional trains or light rail transit; and, more particularly, to a transportation apparatus having an induced freezing rail system, which uses a radio wave to induce freezing of rails and thereby reduce friction between the transportation apparatus and the rails so that long-distance transportation at high acceleration is possible using a small amount of energy, thereby improving transportation efficiency.

2. Description of Related Art

In general, rail-based transportation apparatuses (e.g. trains) have been widely used to transport a large amount of freight or people safely to a destination over a long distance. Trains, the typical rail transportation apparatuses, are regarded as the most efficient means because of the high ratio of fuel to freight weight compared with road transportation means. Although each railroad car of a train may seem inefficient because it is heavier than any road car, it is when a large number of railroad cars are connected to transport freight or passengers that the advantage of railroad transportation, i.e. long-distance large-scale transportation, becomes noticeable.

The reason rail-based trains have better fuel efficiency is that, however heavy they may be, they move on iron rails, which are hard, flat, and straight, distributing the overall friction force consumption. Road cars, contrary to trains, move on curved roads with protrusions, and the friction force consumption increases despite the advantage of wheels. However, even trains have inefficiency in that their large weight and severe friction loss between wheels and rails result in energy consumption and noise.

In an attempt to solve this problem, magnetic levitation trains based on superconductor have been developed. Magnetic levitation trains have less noise and vibration, and can be accelerated easily. However, it is difficult to implement superconductor at room temperature, and magnetic levitation trains simply based on electromagnetic force requires a large amount of current to obtain levitation. Considering the ever-increasing energy cost, there is a need for a new type of apparatus and means for solving the above-mentioned problem.

SUMMARY OF THE INVENTION

An embodiment of the present invention is directed to a transportation apparatus having an induced freezing rail system, which employs freezing rails to reduce friction energy loss occurring between wheels and rails, which has less noise and vibration during operation as in the case of a magnetic levitation train so that freight and people can be transported safely, and which are environment-friendly and requires little cost for maintenance.

Other objects and advantages of the present invention can be understood by the following description, and become apparent with reference to the embodiments of the present invention. Also, it is obvious to those skilled in the art to which the present invention pertains that the objects and advantages of the present invention can be realized by the means as claimed and combinations thereof.

In accordance with an embodiment of the present invention, a transportation apparatus configured to travel on rails includes: a transportation vehicle having a support unit configured to support a frame from the rails; and rail unit comprising a freezing rail system positioned on a ground surface corresponding to the support unit of the transportation vehicle. The rail unit includes a plurality of metal rail grooves formed on a concrete ground surface to guide forward/backward movement of the transportation vehicle, and an induced freezing rail unit having a refrigerant contained in the grooves and cooling devices.

The transportation vehicle further includes front and rear antennas configured to transmit radio waves for inducing freezing of the freezing rails, and the induced freezing rail unit further includes sensors configured to actuate the cooling devices based on wireless communication with the front and rear antennas.

The cooling devices are positioned beneath the metal rail grooves and have a predetermined depth. The cooling devices are configured to freeze the refrigerant from both sides along the rails.

The refrigerant inside the cooling devices of the freezing rail unit further includes protective film inside the metal rail grooves to prevent leakage and evaporation of the refrigerant and penetration of alien substances.

The support unit includes frame blades including shock absorbers, wheels for a powering unit configured to transmit propulsion to the transportation vehicle, and rail wheels configured to move on conventional metal rails in emergency. The powering unit configured to generate propulsion for the vehicle includes wheels configured to move the vehicle through friction with the ground during rotation, and the wheels are coupled to the transportation vehicle so as to move vertically so that, when the transportation vehicle reaches a predetermined speed, the wheels ascend to reduce noise and friction energy. The wheels can descend to touch the ground and increase friction energy when the transportation vehicle needs to slow down or stop.

The support unit includes frame blades inserted into the refrigerant and shock absorbers coupled to the top of the frame blades.

In accordance with an embodiment of the present invention, a transportation apparatus configured to travel on freezing rails includes: a transportation frame having frame blades configured to move on the freezing rails and a support unit for the frame blades; a front antenna positioned on a front portion of the transportation frame to transmit a signal for inducing freezing of the freezing rails before the transportation frame reaches the freezing rails; and a rear antenna positioned on a rear portion of the transportation frame to transmit a signal for releasing freezing maintenance of the freezing rails after the transportation frame passes through the freezing rails.

The frame further includes a position recognition device configured to recognize position information of the transportation frame; and a position transmission device configured to transmit position information of the transportation frame.

DESCRIPTION OF SPECIFIC EMBODIMENTS

Figure 1:
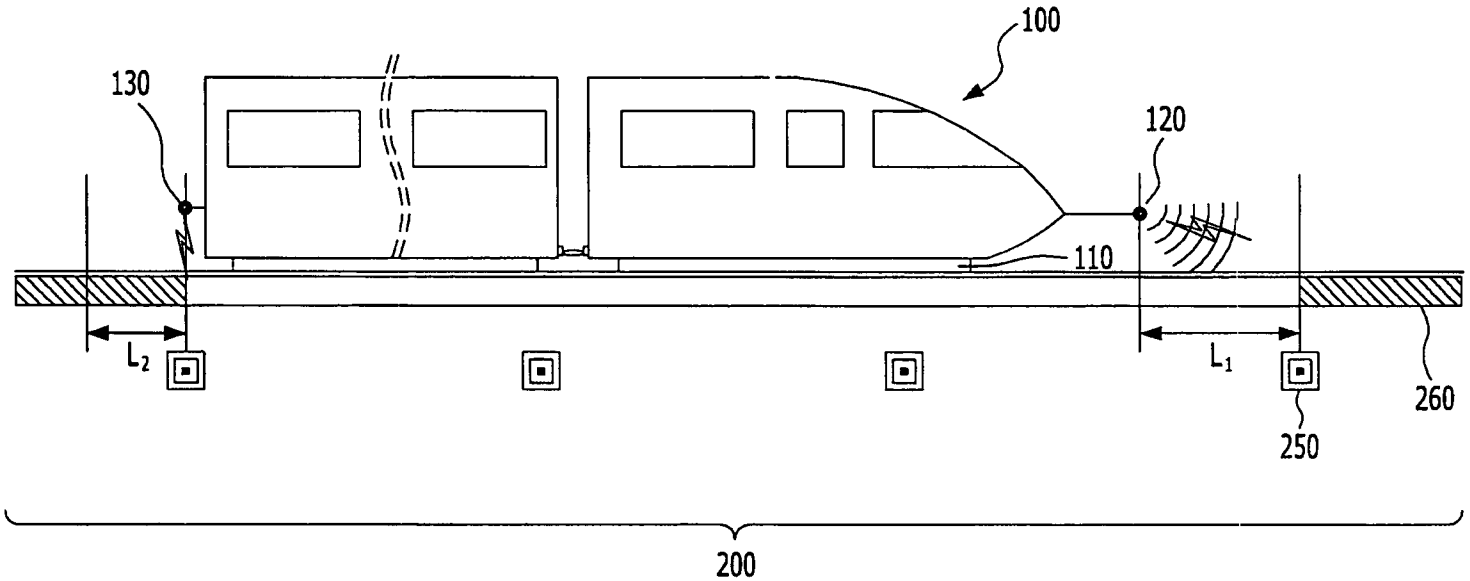
FIG. 1 schematically illustrates a transportation apparatus having an induced freezing rail system, during operation, in accordance with the present invention.

Exemplary embodiments of the present invention will be described below in more detail with reference to the accompanying drawings. The present invention may, however, be embodied in different forms and should not be constructed as limited to the embodiments set forth herein. Rather, these embodiments are provided so that this disclosure will be thorough and complete, and will fully convey the scope of the present invention to those skilled in the art. Throughout the disclosure, like reference numerals refer to like parts throughout the various figures and embodiments of the present invention.

FIG. 1 schematically illustrates a transportation apparatus having an induced freezing rail system, during operation, in accordance with the present invention. Referring to FIG. 1, the transportation apparatus includes a transportation vehicle 100 and an induced freezing rail system 200. The transportation vehicle 100 includes a support unit 110, a front antenna 120, and a rear antenna 130. The support unit 110 is configured to support the frame from the rails. The front and rear antennas 120 and 130 are configured to transmit radio waves for inducing freezing of the induced freezing rail system 200. The induced freezing rail system 200 includes sensors 250 configured to wirelessly communicate with the front and rear antennas 120 and 130, which generate induction waves, to determine whether to operate or not, and induced freezing rails 260. The construction of the induced freezing rails will be described later in more detail with reference to FIGS. 2A to 2C.

According to this construction, the transportation vehicle in accordance with the present invention moves on freezing rails, which are frozen when the refrigerant contained in the rails are cooled by induction waves. This reduces friction energy between metal wheels and metal rails, which occurs in conventional metal rail trains, and the freezing rails have small horizontal movement friction energy as in the case of magnetic levitation trains.

The transportation vehicle 100 is configured to receive all operation-related network situation information through the front and rear antennas 120 and 130. More specifically, the transportation vehicle 100 transmits radio wave containing information regarding the vehicle's speed, position, and condition forward during operation. The sensors 250, which are positioned along the rails at a predetermined interval, are configured to operate in response to the radio wave from the transportation vehicle. Specifically, the sensors 250 determine that the train will pass soon, and cool the refrigerant contained in the rails. The sensors 250 check the condition of the rails and transmit the check result to the transportation vehicle and the control center. The transportation vehicle moves on the rails, which are frozen within a short period of time, to the next position. This mechanism is repeated every time the train travels. The rear antenna 130 transmits a radio wave instructing the sensors 250 behind the train to release the operation of the cooling devices and maintain normal conditions. The cooling devices of the freezing rails are then powered off, and the refrigerant returns to the liquid state.

Alternatively, the transportation apparatus having an induced freezing rail system in accordance with the present invention may be implemented so that, instead of separate front and rear antennas, the sensors are actuated under the control of a central system using a navigation system. Specifically, the transportation apparatus is located using a navigation system, and induced freezing rails in a region, through which the transportation apparatus is supposed to travel, are frozen in advance under the control of the central system.

Furthermore, as shown in FIG. 1, the front antenna 120 is configured to actuate a sensor 250 lying at a predetermined distance L1 from the train based on consideration of the speed of the train and the cooling rate of the refrigerant. This is for the purpose of guaranteeing that the train travels safely on rails frozen by the refrigerant.

Specifically, the power of the radiated wave is increased or decreased in proportion to the speed of the transportation vehicle so that the distance L1 to the front sensor increases or decreases. In other words, the optimal speed to L1 ratio is maintained during operation. As such, all rails in a region through which the train travels remain frozen so that the transportation vehicle smoothly move (or slide) on the rails using its frame blades.

Induced freezing rails and a transportation vehicle using them in accordance with the present invention will now be described in more detail.

Figure 2A:
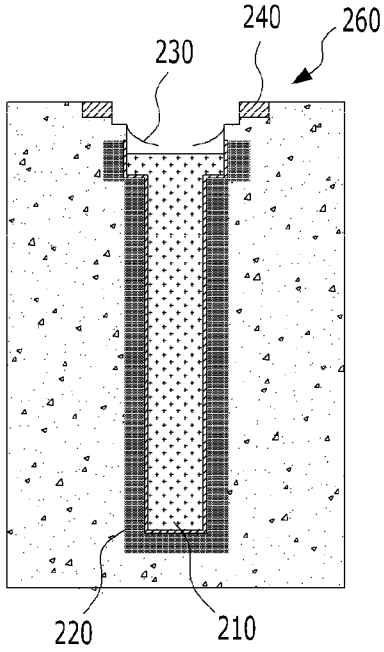
FIGS. 2A to 2C schematically illustrate the condition of an induced freezing rail during operation, as well as the contact condition, of a transportation apparatus having an induced freezing rail system in accordance with the present invention.
Figure 2B:
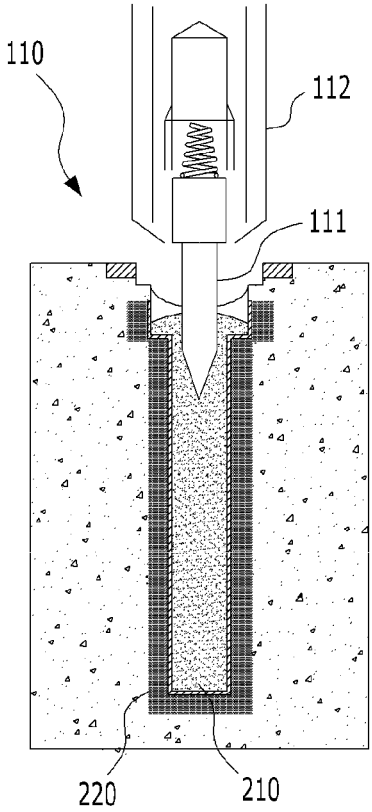
Figure 2C:
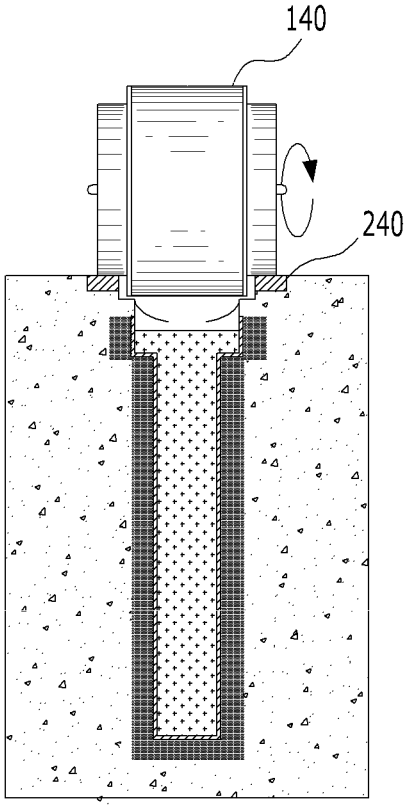

FIG. 2A to 2C schematically illustrate the condition of an induced freezing rail during operation, as well as the contact condition, of a transportation apparatus having an induced freezing rail system 200 in accordance with the present invention. Specifically, FIG. 2A shows an induced freezing rail during a normal condition, FIG. 2B shows the induced freezing rail and the support unit of the transportation vehicle during operation, and FIG. 2C shows the induced freezing rail and the transportation vehicle when a wheel, e.g. a conventional railroad wheel, is used.

As shown in FIG. 2A, the induced freezing rail 260 in accordance with the present invention includes a refrigerant 210, a cooling device 220, protective film 230, and metal rails 240. The basic structure of the induced freezing rail 260 in accordance with the present invention is as follows: a narrow, deep metal groove is formed on a concrete surface, and the groove is filled with a refrigerant 210 having a high freezing point, such as water.

The protective film 230 is installed on top of the groove to prevent leakage and vaporization of the refrigerant 210 and penetration of alien substances. The refrigerant 210 is positioned to be surrounded by the cooling device 220 so that the refrigerant can be cooled fast and easily using a small amount of energy. The reason the induced freezing rail has a very narrow, deep cooling groove structure is for the purpose of guaranteeing that, when the transportation vehicle passes, the refrigerant is cooled within a short period of time to better support the transportation vehicle. Various alternative structures and shapes to this end are obvious to those skilled in the art within the scope of the present invention.

The refrigerant is a compound having a melting point higher than that of water so that it can be cooled easily at a low temperature, but water can also be used considering the cost for material and maintenance. A feedback system serves to maintain the level of the refrigerant, which would otherwise decrease as time elapses, and level detectors within a predetermined distance continuously transmit this information to the central system.

As shown in FIG. 2B, the support unit 110 of the transportation vehicle in accordance with the present invention includes a frame blade 111 inserted into the refrigerant 210 and a shock absorber 120 coupled to the top of the frame blade 111.

The frame blade 111 has the shape of an ice-skate blade, and may be a thin blade made of metallic material. According to this construction, the vehicle weight and friction heat temporarily melt the refrigerant, on which the frame blade passes, and form a liquid surface, and the surface friction decreases. The freezing rail maintains the condition in which the transportation apparatus can slide on the frozen refrigerant.

The reason the refrigerant 210 is contained in a narrow, deep metal groove is that, besides the above-mentioned freezing time efficiency, the surface of the frozen refrigerant is liquefied to support the transportation vehicle with considerable weight so that it can move smoothly. The shock absorber 112 is coupled to the frame blade 111 to absorb shock and vibration from the ground.

The metal rails 240 are configured to support conventional rail wheels when the refrigerant inside the freezing rail is not frozen any longer, i.e. when the rail no longer remains frozen.

Specifically, in such an abnormal condition, the sensors 250 check the overall condition of the rails and transmit a specific radio wave. The front antenna 120 of the transportation vehicle receives the radio wave containing information and recognizes the dangerous situation of the train. In this case, the transportation vehicle is slowed down gradually, and a wheel 140 (e.g. rail wheel used in light rail transmit) descends to the metal rails 240 as shown in FIG. 2C and supports the transportation vehicle so that it can operate as before.

Figure 3:
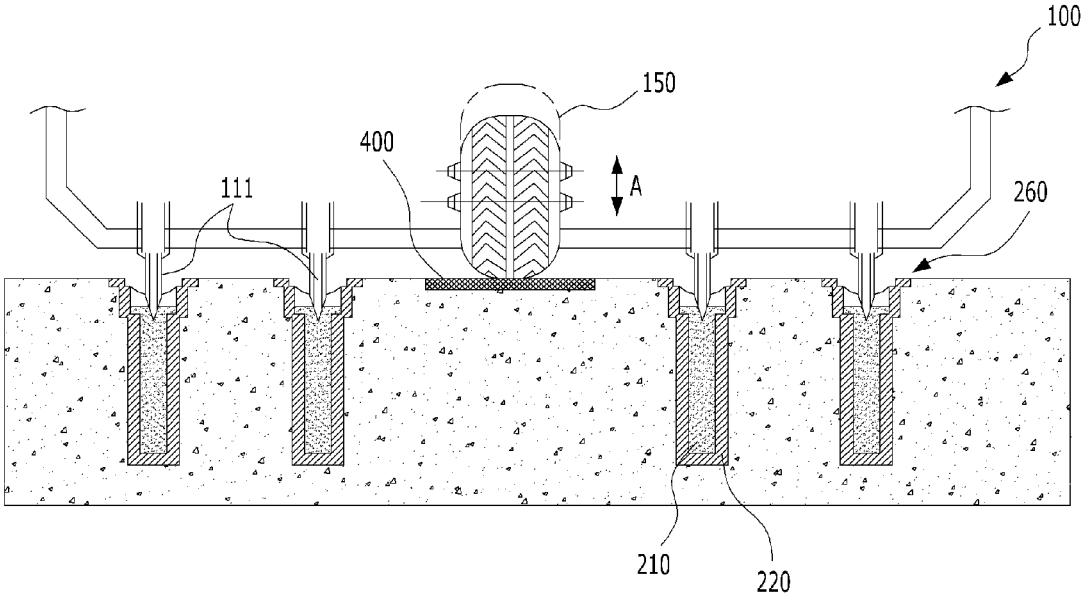
FIG. 3 schematically illustrates the support and movement conditions of a powering unit, during operation, of a transportation apparatus having an induced freezing rail system in accordance with the present invention.

FIG. 3 schematically illustrates the support and movement conditions, during operation, of a transportation apparatus having an induced freezing rail system in accordance with the present invention. As shown, the transportation apparatus 100 having an induced freezing rail system in accordance with the present invention further includes a powering unit (not shown) positioned beneath to generate propulsion.

The powering unit includes a wheel 150 configured to move the vehicle through friction with the ground during rotation. The frame blades 111 attached to the frame are basically configured to support the frame and reduce friction force in the traveling direction. Therefore, a powering unit is needed to move and stop the frame. Rubber tire wheels may be used to power the vehicle as in the case of conventional vehicles, although there are other power transmission methods including methods using a rope, propellant, etc.

The transportation vehicle 100 in accordance with the present invention is placed on rails, which have little friction force against horizontal movement, as in the case of a magnetic levitation train, and begins to move by means of the rubber tire wheel 150 supported on the wheel ground surface 400. Power is continuously transmitted to the wheel 150 until a predetermined speed is reached. The wheel 150 can ascend as indicated by A in FIG. 3 to reduce friction with the ground after the target speed is reached. When the transportation vehicle is to be stopped, the rubber tire wheel 150 descends as indicated by A in FIG. 3 so as to increase friction and slow down as in the case of an automobile. As such, the wheel 150 provides power for moving the transportation vehicle and friction for stopping it.

Although the transportation vehicle in accordance with an embodiment of the present invention shown in FIG. 3 has four frame blades 111, the number of the frame blades 111 can be increased or decreased (as long as it is plural) considering the weight of the vehicle and the balance of force, and a plurality of wheels 150 may also be used.

In accordance with the exemplary embodiments of the present invention, the transportation apparatus having an induced freezing rail system employs a freezing rail system to reduce ground surface friction so that, compared with conventional trains, a higher speed can be obtained using lesser energy (i.e. effigy-efficient). The apparatus exhibits not only substantially reduced noise, but also less vibration during operation so that passengers or freight can be transported safely. In emergency, the apparatus can also be used together with conventional metal rails.

While the present invention has been described with respect to the specific embodiments, it will be apparent to those skilled in the art that various changes and modifications may be made without departing from the spirit and scope of the invention as defined in the following claims.

What is claimed is:

1. A transportation apparatus comprising:

a transportation vehicle having a frame and a support unit configured to support the frame;

a freezing rail system comprising a freezing rail on which the support unit is disposed, the freezing rail having a refrigerant and a cooling device, wherein the transportation vehicle further includes a front antenna and a rear antenna that are configured to transmit radio waves for inducing freezing of the freezing rail, and the freezing rail system further includes a sensor configured to actuate the cooling device based on wireless communication with the front and rear antennas.

2. The transportation apparatus of claim 1, wherein the cooling device is positioned to enclose the refrigerant.

3. The transportation apparatus of claim 1, wherein the freezing rail further comprises a protective film configured to prevent leakage and evaporation of the refrigerant and penetration of alien substances, the frame blade being inserted into the protective film.

4. The transportation apparatus of claim 1, wherein the transportation vehicle further comprises a rail wheel and the freezing rail further comprises a metal rail configured to support the rail wheel.

5. The transportation apparatus of claim 1, wherein the transportation vehicle further comprises a powering unit positioned beneath to generate propulsion.

6. The transportation apparatus of claim 5, wherein the freezing rail is positioned on a ground surface, and the powering unit comprises a wheel configured to move the transportation vehicle through friction with the ground surface during rotation, and the wheel is coupled to the transportation vehicle so as to move vertically so that, when the transportation vehicle reaches a predetermined speed, the wheel ascends away from the ground surface.

7. A transportation apparatus comprising:

a transportation vehicle having a frame and a support unit configured to support the frame;

a freezing rail system comprising a freezing rail on which the support unit is disposed, the freezing rail having a refrigerant and a cooling device, wherein the support unit comprises a frame blade inserted into the refrigerant and a shock absorber coupled to a top of the frame blade.

8. A transportation apparatus configured to travel on freezing rails, comprising:

a transportation frame having frame blades configured to move on the freezing rails and a support unit for the frame blades;

a front antenna positioned on a front portion of the transportation frame to transmit a signal for inducing freezing of the freezing rails before the transportation frame reaches the freezing rails; and a rear antenna positioned on a rear portion of the transportation frame to transmit a signal for releasing freezing maintenance of the freezing rails after the transportation frame passes through the freezing rails.

9. The transportation apparatus of claim 8, wherein the transportation frame further comprises:

a position recognition device configured to recognize position information of the transportation frame; and a position transmission device configured to transmit position information of the transportation frame.

10. An induced freezing rail comprising:

a groove extending from a ground surface in a narrow and deep shape;

a refrigerant filling the groove;

a cooling device positioned on an outer periphery of the refrigerant;

refrigerant protective film formed on top of the groove;

a sensor configured to actuate the cooling device; and a metal rail formed on an upper outer periphery of the groove.

* * * * *